United States Patent [19]

Jenkins et al.

[11] 4,254,565

[45] Mar. 10, 1981

[54] METHOD FOR THE SEGMENTED MINING AND DRYING OF BENTONITE

[75] Inventors: Jerold D. Jenkins, Spearfish, S. Dak.; Robert A. Falconer, Birmingham; Donald A. Hentz, Farmington Hills, both of Mich.

[73] Assignee: International Minerals & Chemical Corp., Terre Haute, Ind.

[21] Appl. No.: 92,600

[22] Filed: Nov. 8, 1979

Related U.S. Application Data

[63] Continuation of Ser. No. 949,488, Oct. 10, 1978, abandoned, which is a continuation-in-part of Ser. No. 791,260, Apr. 27, 1977, abandoned.

[51] Int. Cl.[3] ..... E02F 1/00

[52] U.S. Cl. ..... 37/195; 34/42; 299/10

[58] Field of Search ..... 37/195, 1, 3; 299/10; 34/42

[56] References Cited

PUBLICATIONS

Wolfbauer, C. A., "Bentonite in the Powder River Basin, Wyoming", *Wyoming Geological Association 28th Annual Field Conference Guidebook–1976–Geology and Energy Resources of the Powder River*, pp. 257–259.

*Primary Examiner*—Clifford D. Crowder

*Attorney, Agent, or Firm*—H. J. Barnett

[57] ABSTRACT

A method for drying, curing and mining bentonite clay in a clay pit wherein that overburden of non-clay material which may exist is removed and the surface of the bentonite ore body is tilled to loosen or break up a tier of the bentonite to expose it to the natural drying and curing effects of the atmosphere, the dried and cured tier of bentonite is removed thus exposing another tier of uncured bentonite, which is again tilled for drying and curing, and the process is repeated until the bentonite ore body is exhausted.

4 Claims, No Drawings

METHOD FOR THE SEGMENTED MINING AND DRYING OF BENTONITE

This application is a continuation of U.S. application Ser. No. 949,488 filed Oct. 10, 1978, which is a continuation-in-part of U.S. application Ser. No. 791,260 filed Apr. 27, 1977, both now abandoned.

BACKGROUND OF THE INVENTION

This invention relates to a novel method for the combined drying, curing, and mining of bentonite clay.

Bentonite clay is found in beds of varying thickness. Overburden depth usually dictates that the economically mineable thickness of the bentonite beds be from two to about four feet or thicker. The means or techniques by which these beds are harvested and processed determine the clay's eventual potential and/or value as an industrial mineral.

Bentonite clay is made up of extremely small platelike crystals stacked in layers. Due to inherent crystallography and certain characteristic charge densities thereon, bentonite possesses the ability to organize and rigidify water upon and near the faces of the individual crystals. In situ bentonites hold organized water at levels of thirty-two percent. Bentonite as such is of no real economic or industrial value. Bentonite must be processed and dried to certain critical levels of moisture content of about 12% and the techniques involved in so processing and drying are of the greatest importance if the ultimate potential and value of the bentonite is to be realized. Bentonite can be, and is, overdried. Overdrying is brought about by removal of all the water from between the faces of the clay platelets with the concomitant face to face junction of the crystals. Certain forces (Van der wals) then make the readsorption of water, for all practical purposes, impossible, thus destroying much, if not all, the bentonite's ultimate value. Underdrying, though less destructive than overdrying, provides a bentonite clay of sluggish and inadequate response.

Bentonite clay is generally mined in large lumps containing large amounts of moisture. It is, therefore, necessary to dry and reduce the size of the clay before it is sold in order that it may be more easily transported and used in subsequent industrial processes. Ladoo and Meyers, *Non-Metallic Minerals*, Second Edition (1951), pages 96–98.

Early methods for mining bentonite consisted of digging by hand or plowing the bentonite with a team of horses than raking the clay to dry over steel plates heated by coal or wood fires (Wolfbauer, C. A., Bentonite in the Powder River Basin, *Wyoming Geological Association 28th Annual Field Conference Guidebook*, 1976 *Geology and Energy Resources of the Powder River, Casper, Wyoming, September* 1976, Ed. Landon, R. B.). Bentonite mined by these early techniques was found in outcroppings which were already dried and cured to a large extent, because of exposure to the atmosphere. In principle, the early methods of mining bentonite and the conventional methods used today are the same. The wet clay is removed from the pit and transported to a drying facility. In the early methods, the drying facility was a heated steel plate located in the pit whereas today the drying facility is a modern plant located many miles from the pit.

In the conventional mining of bentonite clays the overburden is removed to expose the bentonite. The bentonite clay displays the natural ability to block the passage of water. It is then usual that the exposed bentonite within a pit be drained peripherally, such that no water be allowed to collect or build up thereon. This process is commonly referred to in the art as "cupping" the bentonite clay pit. The efficient and prudent use of bentonite as presently mined dictates the clay be cured an extended period of time prior to plant processing. The term curing as used herein refers to that natural process which is evidenced as bentonite dewaters through exposure to the natural drying effects of the environment. Bentonite when so exposed delaminates and exfoliates from the surface of the ore body to a given but shallow depth. This delamination and exfoliation is characterized by a granule which attains dimensions nearly spherical and which is driest at its core; for as the uppermost surface dries it shrinks, thereby lifting a shoulder of wetter clay up and around the dryer portion until the process is culminated by the forming granule plucking itself free from the wetter ore body. This low density granule will attain a dimension roughly one-half inch in diameter and has been referred to within the industry and the literature as a "popcorn" structure. The total exposed surface of an ore body, outcrop or pile will display this phenomenon quite swiftly. Due to the protective nature of this dried-cured bentonite, that portion of the ore body which underlies the cured bentonite will remain at or near its natural state.

As a naturally-occurring process, an ore body will cure to a thickness of from one-half to one inch in depth. It has been found if the uppermost surface of the ore body is broken up curing will progress at a swifter rate more deeply into the ore body. Depending upon prevailing environmental conditions, the cured layer will possess from ten to about eighteen percent moisture.

Conventional clay mining techniques involve removal of the entire thickness of the clay bed at one time using equipment such as endloaders. If time permits, the surface of the clay deposit may be tilled and exposed to atmospheric drying for a period of from six to eighteen months; however, even if this technique is used, the clay only cures to a depth of a few inches to a foot, whereas, the vast majority of the deposit remains in an uncured state.

Original ore moisture is about thirty-two percent. Clay mined by conventional techniques generally contains moistures in the range of from twenty-five percent to thirty-two percent. Very little drying or curing is evidenced prior to harvesting, even when the surface of the clay deposit is tilled prior to removal. That small amount of clay which enjoyed some drying and curing is harvested along with that vastly larger bulk of clay which is undried and uncured. The entire clay deposit is placed into trucks which traverse long distances, hauling a material which contains from twenty-five percent to thirty-two percent moisture. Common practice among clay mining companies is to have the wet clay hauled to the processing plant by contract haulers, whose charges are based on the weight of the clay. Thus, producers pay considerable sums for the hauling of excess moisture in the clay. Furthermore, the wet clay as mined from the earth is sticky and difficult to handle. It sticks to the buckets of endloaders and to truck beds, often requiring operators to slam the buckets against the truck bed to dislodge the clay. This technique is time consuming and, of course, causes severe wear and tear on the equipment.

The clay is conventionally dumped on stockpiles adjacent the processing plants. Heavy machinery is used to spread the dumped clay over large wedge-shaped stockpiles. While conveying and spreading the clay on the piles, the machinery compresses and densifies the stockpiles. Such compacted clay seldom falls below a moisture level of twenty-five percent and is of variegated sizing, from near dust to compacted lumps in excess of one foot in diameter. Due to the sizing and the moisture level of the clays removed from the stockpiles, it is necessary that the clay pass through a special crusher which is externally heated to preclude sticking and clay buildup within the crusher. The special externally heated crusher is a necessary step prior to the finish drying of clay as it is presently mined. Clay is circulated through the heated crusher until it is of a size most efficiently managed in the drying process. Bentonite clay mining, using present techniques, is finish dried to a moisture level of about 9% from a level of from twenty-five percent to thirty-two percent moisture.

As clay is presently mined and processed there is, of necessity, a compromise struck in the drying process. Within the finish dryer exists granules of clay in excess of one-inch diameter with grading down to dust sized particles. The small percentage of dust sized particles are usually blown out or through a dryer swiftly. The larger granules and chunks are overdried peripherally and underdried at the core for bentonite effectively blocks the movement of water from the core to the periphery. As the outer surface of the granule or chunk dries, it heals over or armors itself against the ingress or egress of water. At finish grinding there then exists a bentonite product made up of a compromise average of overdried and underdried clay mixed with a small percentage of adequately dried clay. The most important factors influencing this type of inefficient, wasteful and destructive drying is the high moisture content and uncured state of the incoming bentonite clay.

It is apparent that large amounts of energy are required to transport, crush, and dry the wet clay to a granular material having a moisture content of about 9%. In the interest of a more intelligent, judicious, efficient and ultimately more conservative utilization of the natural resource, bentonite, and a more efficient and conservative usage of energy, man made and natural, the invention of a novel mining, drying and curing technique for the processing and manufacture of bentonite is herein described.

SUMMARY OF THE INVENTION

This invention is directed to a method for the segmented mining, drying and curing of bentonite clay comprising removing that overburden that may exist from the bentonite clay bed, tilling the bentonite clay to a depth of from two to eight inches to promote drying and curing of the tilled bentonite, removing the dried and cured segment of bentonite, exposing the bentonite clay therebelow, tilling the exposed bentonite clay to promote drying and curing in preparation for removal and repeating the steps of the method until the bentonite clay bed has been exhausted.

DETAILED DISCUSSION

The method of mining, drying and curing bentonite clays contemplated by this invention begins with the removal of that overburden which may exist over the clay deposit. The overburden, generally in varying depths of from about two to forty feet, can be removed by any convenient process or equipment, many of which are known in the art.

Following the exposure of the clay, the uppermost surface of the bentonite ore body is tilled, e.g. worked to open and expose a tier or segment of bentonite in such a manner that will allow a maximum amount of the bentonite to dry and cure. The maximum amount of bentonite that can be dried-cured is dependent upon the natural characteristics of the bentonite clay such as its ability to armor itself against further drying and its ability to dry via the "popcorn" effect. The objective of the tilling is to expose and increase the surface area of the bentonite in order to gain the greatest benefit of the "popcorn" effect drying of the bentonite without breaking up the bentonite in a manner that self-armoring occurs. Generally, the degree of working or opening the ore surface is controlled by the type of clay in the pit. For most bentonite clays, the method of this invention is employed by loosening, breaking-up, opening or exposing the ore at a depth of from two to eight inches. Preferably, the ore is opened to a depth of from four to six inches. It was found that at depths greater than eight inches no significant benefit was gained by the tilling when compared to non-tilling. By breaking up the bentonite ore at depths greater than eight inches, the lumps or pieces turned over or broken off are of a size that allows inadequate curing of the entire lump of clay. The lumps formed by tilling at depths greater than eight inches do not promote the curing benefit that is derived from the "popcorn" effect. These lumps tend to armor themselves by forming a protective coating on the outside layer which inhibits the moisture from within being lost. The lumps of clay will require crushing and drying and will, therefore, lose the benefit that is gained by practicing the method of this invention. It was found that disking the clay bed to a depth of from four to six inches promoted the curing of the clay and enhanced the benefit that is derived from the clay's natural ability to dry-cure via the "popcorn" effect.

Any convenient machinery or equipment such as disks, harrows, roto-tills or other equipment which may be set, built or controlled to loosen, break-up, open or expose a tier of the ore body can be used in the practice of the method of this invention. Preferably, a disk is used to loosen the bentonite ore. Most preferable is the use of a piece of equipment on which the depth of penetration into the ore body can be controlled due to the varying compositions and characteristics of the clay beds.

At the time the first tier or segment is dried-cured the tier or segment is removed. The time for which the bentonite is dried-cured is dependent upon the weather conditions and the type of clay. Generally this period will be from four hours to one week, a vast time savings over the conventional processes. The bentonite ore is removed from the pit when the disked tier has dried-cured to a moisture content of less than twenty-four percent. Preferably, the bentonite is removed at a moisture level of from ten to eighteen percent. Only that tier of ore that has dried-cured to the preferred moisture content is removed. Any suitable means capable of removing a layer of clay to a certain depth can be used in the practice of this invention; however, the preferred method involves the use of a power driven loader which is designed to pick up particulate material to a controlled depth. The power loader advantageously includes one or more conveyor belts to transport the dried and cured clay to a truck which may be driven along side of the power loader. Particularly preferred equipment for loading the cured and dried tier of clay is the Athey ® force-feed loader manufactured by Athey Products Corporation, P.O. Box 669, Raleigh, N.C.

When the dried-cured tier of clay is removed, it can be transported to a cone-shaped storage pile ready for use or for further processing if needed. With the removal of the cured tier or segment, unaltered bentonite is exposed which is worked as was the previous tier or segment and allowed to dry and cure. After drying and curing to the preferred moisture content, this tier or segment is removed. This method of segmenting by tiers, disking to open the bentonite to promote drying and curing, removing only the dried-cured tiers, is followed until the bentonite ore within the pit is exhausted.

As the bentonite clay is removed from the pit, it can be stored in cone-shaped stockpiles. These stockpiles are self-protecting against inclement weather due, surprisingly, to their low moisture content. It has been found that bentonite of less than twenty-four to twenty-five percent moisture content can protect itself from adverse weather when placed in cone-shaped piles. If the cone-shaped stockpile becomes wet, the outer layer will swell due to the absorption of water to the extent that it cannot swell further and will, thereafter, become impermeable to the passage of water thus protecting the rest of the bentonite within the stockpile. This is a considerable advantage over the present day stockpiling of bentonite clays of greater than twenty-four percent moisture. Clays of greater than twenty-four percent moisture content are already swollen and cannot, therefore, form a barrier to water. Water channels its way into the stockpile further increasing the moisture content of the clay and thereby reducing the quality.

The method of this invention provides may improvements over the prior known methods of mining and drying bentonite. Using the method of this invention, the efficient and beneficial effects of the natural environment are used to predry and cure the bentonite to such levels that processing plant treatment becomes less a total drying operation and more an efficient, less destructive finishing step. Pre-dried and cured clay of a consistent sizing is provided the processing plant. The homogeneous size, moisture content and open structure of the granules mined by the method of this invention, when exposed to industrial drying techniques, dry at a higher more governable rate and a product is yielded which displays little or no loss of those qualities deemed valuable in the industry. Due to the sizing and to the low moisture content of the incoming bentonite, the extra cost in time and energy represented by the large heated crusher is avoided. It has been shown higher finish grinding efficiencies are enjoyed after clay, mined and cured by the method of this invention, has been finish dried; for the finish grinding mills see a more homogeneously dried more open-structured target. By the method of this invention, bentonite, which has been pre-dried and cured to from twelve to eighteen percent moisture is exposed to finish drying in a state which requires less heat and time for finish drying. The pre-dried and cured granules exhibit less density and/or a more open structure which allows drying to progress more rapidly at lower, less damaging temperatures. It has been found that savings of forty percent or more in fuel costs are evidenced in drying bentonite mined by the process of this invention.

The method of this invention precludes the costly and time consuming necessity of cupping the ore body. The recovery of the pit areas are completed more swiftly, since the period is shortened from the time the overburden is removed to the time the clay pit is exhausted. Using the method of this invention, a two to four foot bed of bentonite can be efficiently mined and recovered within one to twelve weeks, whereas the current method of mining leaves the pit open for one to one and one-half years. This represents a savings in time and energy and provides an ecological benefit in quick recovery, for through the expenditure of large periods of time the overburden piles tend to compact and the valuable top soil piles tend to erode.

The method of this invention provides a dried-cured product at the pit site which is characterized by a moisture weight reduction of from fourteen to twenty-two percent. Transportation of the bentonite is more economical. At any time the bentonite is moved, a savings of from fourteen to twenty-two percent is enjoyed in space, time and energy.

Since the bentonite is dried-cured at the pit site, there is no need to stockpile and work it toward further drying. The use of heavy machinery to move and work stockpiles is negated. The bentonite can be loaded as it is mined for transportation to the facility where it is to be processed and may be processed immediately.

Taxable inventory at the bed and at the plant site is reduced for it is not necessary to maintain excessively large stockpiles which necessitate long working, drying and curing times.

There are also benefits at the plant where bentonite is processed. That bentonite mined by the method of this invention is stored at the plant site in large, self-protecting, cone-shaped piles. The piles are of low density pre-dried and cured clay. Harvesting bentonite from these piles represents savings in time and energy when compared to conditions as they exist as regards present day or conventional stockpiles. Present day or conventional stockpiles under certain weather conditions and/or due to the inherent extremely high densities evidenced therein are at times literally impossible to harvest. It has been shown bentonite mined by the process of this invention and formed into stockpiles retains a loose, low density pile which can be effectively harvested regardless of weather conditions. This represents a savings in time and energy and enhances machinery longevity.

Those characteristics of bentonite regarded as valuable or as standards of quality are enhanced through the method of this invention. Certain bentonite beds regarded as substandard for various reasons as processed in the past can now, by the use of this invention, qualify for certain end uses. More efficient use of the total bentonite resource can take place through the method of this invention.

Heretofore, no method for field drying, curing and mining bentonite has involved tilling to effect drying and curing of a tier of bentonite, followed by removing only the dried and cured tier while leaving the remaining undried clay for further field drying and recovery. Prior art methods have all involved removal of undried clay from the pit and transported to a drying plant. The present invention, therefore, constituted a patentable contribution to the art.

We claim:

1. An improved method for mining of bentonite clay having a moisture content of 25–32%, the steps comprising tilling an exposed bentonite clay deposit to a uniform depth of not more than about eight inches, drying and curing the tilled bentonite in situ by exposure to sun and air until said tilled bentonite reaches a uniform moisture level of not more than about 18%, removing only the dried and cured tilled bentonite, thereby exposing the bentonite therebelow, tilling the exposed layer of bentonite to a uniform depth of not more than about eight inches to promote drying and curing and thereafter repeating the removal, tilling, in situ drying and curing steps to obtain a bentonite clay having a uniform particle size and uniform moisture level not more than about 18%.

2. An improved method for recovering uniform quality bentonite clay from a field deposit of bentonite containing about 25–32% moisture having an exposed surface layer of bentonite clay, the steps comprising mechanically working the exposed surface layer of the field deposit in situ to thereby reduce said exposed surface layer to a finely divided particulate material having a uniform depth in the range of two to eight inches, allowing said particulate material to air dry in situ to a uniform moisture content of less than 18% by exposure to sun and air, thereafter carefully removing only said air dried particulate material from said field deposit in the air dried condition, whereby a field dried bentonite clay having a uniform particle size, and having a uniform moisture content of less than 18% is obtained.

3. The method of claim 2, wherein the particulate material is removed from the field deposit when the moisture content thereof is in the range of ten to eighteen percent.

4. The method of claim 2, wherein the exposed surface layer of bentonite clay is mechanically worked to a depth of from four to six inches to form a thin surface layer of finely divided particulate material whereby adequate air drying and curing thereof is insured before removal from said field deposit.

* * * * *